US008684601B2

(12) United States Patent
Perell

(10) Patent No.: US 8,684,601 B2
(45) Date of Patent: Apr. 1, 2014

(54) STORAGE APPARATUS WITH A BREACHABLE FLOW CONDUIT FOR DISCHARGING A FLUID STORED THEREIN

(75) Inventor: William S. Perell, San Francisco, CA (US)

(73) Assignee: PopPack, LLC, San Francisco, CA (US)

( * ) Notice: Subject to any disclaimer, the term of this patent is extended or adjusted under 35 U.S.C. 154(b) by 1010 days.

(21) Appl. No.: 11/713,114

(22) Filed: Mar. 2, 2007

(65) Prior Publication Data

US 2008/0212904 A1 Sep. 4, 2008

(51) Int. Cl.
*B65D 33/00* (2006.01)
*B65D 65/26* (2006.01)

(52) U.S. Cl.
USPC ..... 383/211; 383/210; 383/38; 383/40; 383/906

(58) Field of Classification Search
USPC ..... 383/210, 210.1, 211, 38–40, 906
See application file for complete search history.

(56) References Cited

U.S. PATENT DOCUMENTS

| | | | |
|---|---|---|---|
| 2,916,886 | A | 12/1959 | Robbins |
| 3,074,544 | A | 1/1963 | Bollmeier et al. |
| 3,120,336 | A | 2/1964 | Whatley, Jr. |
| 3,189,227 | A | 6/1965 | Hobbs et al. |
| 3,256,981 | A | 6/1966 | Kurtz |
| 3,294,227 | A | 12/1966 | Schneider et al. |
| 3,301,390 | A | 1/1967 | Via, Jr. |
| 3,342,326 | A | 9/1967 | Zackheim |
| 3,419,137 | A | 12/1968 | Walck, III |
| 3,573,069 | A | 3/1971 | Keller et al. |
| 3,608,709 | A | 9/1971 | Pike |
| 3,635,376 | A | 1/1972 | Hellstrom |
| 3,921,805 | A | 11/1975 | Compere |

(Continued)

FOREIGN PATENT DOCUMENTS

| | | |
|---|---|---|
| DE | 20314741 | 1/2004 |
| EP | 00306207 A1 | 3/1989 |

(Continued)

OTHER PUBLICATIONS

International Search Report and Opinion, PCT/US2008/075011, dated Mar. 12, 2009.

(Continued)

*Primary Examiner* — Jes F Pascua
*Assistant Examiner* — Peter Helvey
(74) *Attorney, Agent, or Firm* — Dority & Manning, P.A.

(57) ABSTRACT

Apparatus 10 has breachable flow conduit 12 for discharging stored fluid 12F contained in storage chamber 10C out to the ambient. Chamber access region 10R is positioned proximate perimeter 10P of the apparatus. The breachable flow conduit is within the access region, and has an inner end 12C proximate the storage chamber and an outer end 12P proximate the perimeter of the apparatus. The flow conduit has outer pressed seal 14P between the outer end of the flow conduit and the perimeter of the apparatus. The flow conduit also has inner pressed seal 14C between the inner end of the flow conduit and the edge of the storage chamber. The flow conduit expands towards the perimeter of the apparatus under external pressure, typically applied by the consumer. The pressure causes the flow conduit to breach at the perimeter of the apparatus. The flow conduit also expands towards the storage chamber. The pressure causes the flow conduit to breach at the edge of the storage chamber. Breached flow conduit 13B establishes fluid communication between the storage chamber and the ambient for discharge of the stored fluid.

32 Claims, 3 Drawing Sheets

(56) References Cited

U.S. PATENT DOCUMENTS

| | | | | |
|---|---|---|---|---|
| 3,964,604 | A | 6/1976 | Prenntzell | |
| 4,275,840 | A | 6/1981 | Staar | |
| 4,301,923 | A | 11/1981 | Vuorento | |
| 4,402,402 | A | 9/1983 | Pike | |
| 4,485,920 | A | 12/1984 | Skylvik | |
| 4,491,245 | A * | 1/1985 | Jamison | 222/107 |
| 4,511,052 | A | 4/1985 | Klein et al. | |
| D279,808 | S | 7/1985 | Pharo | |
| 4,540,089 | A | 9/1985 | Maloney | |
| 4,597,244 | A | 7/1986 | Pharo | |
| 4,610,684 | A | 9/1986 | Knox et al. | |
| 4,632,244 | A | 12/1986 | Landau | |
| 4,704,314 | A | 11/1987 | Hsu et al. | |
| 4,711,359 | A | 12/1987 | White et al. | |
| 4,759,472 | A | 7/1988 | Strenger | |
| 4,793,123 | A | 12/1988 | Pharo | |
| 4,798,288 | A | 1/1989 | Holzner | |
| 4,859,521 | A | 8/1989 | Pike et al. | |
| 4,872,556 | A | 10/1989 | Farmer | |
| 4,872,558 | A | 10/1989 | Pharo | |
| 4,874,093 | A | 10/1989 | Pharo | |
| 4,889,884 | A | 12/1989 | Dust et al. | |
| 4,890,744 | A | 1/1990 | Lane, Jr. et al. | |
| 4,918,904 | A | 4/1990 | Pharo | |
| 4,935,283 | A * | 6/1990 | Jamison | 428/174 |
| 4,949,530 | A | 8/1990 | Pharo | |
| 4,961,495 | A | 10/1990 | Yoshida et al. | |
| 4,988,016 | A * | 1/1991 | Hawkins et al. | 222/92 |
| 5,050,736 | A | 9/1991 | Griesbach | |
| 5,100,028 | A | 3/1992 | Seifert | |
| 5,114,004 | A | 5/1992 | Isono et al. | |
| 5,126,070 | A | 6/1992 | Leifheit et al. | |
| 5,131,760 | A | 7/1992 | Farmer | |
| 5,137,154 | A | 8/1992 | Cohen | |
| 5,207,320 | A | 5/1993 | Allen | |
| 5,215,221 | A | 6/1993 | Dirksing | |
| 5,272,856 | A | 12/1993 | Pharo | |
| 5,325,968 | A | 7/1994 | Sowden | |
| 5,373,966 | A | 12/1994 | O'Reilly et al. | |
| 5,427,830 | A | 6/1995 | Pharo | |
| 5,445,274 | A | 8/1995 | Pharo | |
| 5,447,235 | A | 9/1995 | Pharo | |
| 5,487,470 | A | 1/1996 | Pharo | |
| 5,492,219 | A | 2/1996 | Stupar | |
| 5,564,591 | A | 10/1996 | Christine | |
| 5,588,532 | A | 12/1996 | Pharo | |
| D386,074 | S | 11/1997 | Pharo | |
| 5,711,691 | A | 1/1998 | Damask et al. | |
| 5,775,491 | A | 7/1998 | Taniyama | |
| 5,792,213 | A | 8/1998 | Bowen | |
| 5,814,159 | A | 9/1998 | Paley et al. | |
| 5,824,392 | A | 10/1998 | Gothoh | |
| 5,865,309 | A | 2/1999 | Futagawa et al. | |
| 5,870,884 | A | 2/1999 | Pike | |
| 5,910,138 | A | 6/1999 | Sperko et al. | |
| 5,928,213 | A | 7/1999 | Barney et al. | |
| 5,944,709 | A | 8/1999 | Barney et al. | |
| 5,967,308 | A | 10/1999 | Bowen | |
| 6,001,187 | A | 12/1999 | Paley et al. | |
| 6,007,264 | A | 12/1999 | Koptis | |
| 6,036,004 | A | 3/2000 | Bowen | |
| 6,068,820 | A | 5/2000 | De Guzman | |
| 6,165,161 | A | 12/2000 | York et al. | |
| 6,198,106 | B1 | 3/2001 | Barney et al. | |
| 6,203,535 | B1 | 3/2001 | Barney et al. | |
| 6,290,801 | B1 | 9/2001 | Krampe et al. | |
| 6,468,377 | B1 | 10/2002 | Sperko et al. | |
| 6,491,159 | B2 | 12/2002 | Shibata | |
| 6,547,468 | B2 | 4/2003 | Gruenbacher et al. | |
| 6,645,191 | B1 * | 11/2003 | Knerr et al. | 604/410 |
| 6,658,400 | B2 | 12/2003 | Perell et al. | |
| 6,692,150 | B2 | 2/2004 | Hoshino | |
| 6,726,364 | B2 | 4/2004 | Perell et al. | |
| 6,743,451 | B2 * | 6/2004 | Rasile et al. | 426/112 |
| 6,846,305 | B2 | 1/2005 | Smith et al. | |
| 6,935,492 | B1 | 8/2005 | Loeb | |
| 6,938,394 | B2 | 9/2005 | Perell | |
| 6,968,952 | B2 | 11/2005 | Crevier et al. | |
| 6,996,951 | B2 | 2/2006 | Smith et al. | |
| 7,004,354 | B2 | 2/2006 | Harper | |
| 7,040,483 | B2 * | 5/2006 | Inuzuka et al. | 206/219 |
| 7,051,879 | B2 | 5/2006 | Ramet | |
| 7,055,683 | B2 | 6/2006 | Bourque et al. | |
| 7,175,614 | B2 | 2/2007 | Gollier et al. | |
| 7,306,095 | B1 | 12/2007 | Bourque et al. | |
| 7,306,371 | B2 | 12/2007 | Perell | |
| 7,597,691 | B2 | 10/2009 | Kawaguchi et al. | |
| 7,644,821 | B2 | 1/2010 | Perell | |
| RE41,273 | E * | 4/2010 | Perell | 383/210 |
| 7,757,893 | B2 * | 7/2010 | Perell | 222/107 |
| D654,790 | S * | 2/2012 | Perell et al. | D9/434 |
| 2002/0094141 | A1 * | 7/2002 | Hoshino | 383/210 |
| 2002/0150658 | A1 | 10/2002 | Morrissette et al. | |
| 2002/0170832 | A1 | 11/2002 | Klair | |
| 2003/0019781 | A1 | 1/2003 | Kocher | |
| 2003/0102229 | A1 * | 6/2003 | Inuzuka et al. | 206/219 |
| 2003/0113519 | A1 | 6/2003 | Wasserman et al. | |
| 2004/0057638 | A1 | 3/2004 | Perell et al. | |
| 2004/0226848 | A1 | 11/2004 | Dunn-Rankin | |
| 2006/0023976 | A1 | 2/2006 | Alvater et al. | |
| 2006/0126970 | A1 | 6/2006 | Perell | |
| 2007/0235369 | A1 | 10/2007 | Perell | |
| 2007/0237431 | A1 * | 10/2007 | Perell | 383/3 |
| 2007/0284375 | A1 | 12/2007 | Perell | |
| 2007/0286535 | A1 | 12/2007 | Perell | |
| 2007/0295766 | A1 | 12/2007 | Perell | |
| 2008/0212904 | A1 | 9/2008 | Perell | |

FOREIGN PATENT DOCUMENTS

| | | | |
|---|---|---|---|
| EP | 00317130 | A1 | 5/1989 |
| EP | 0709302 | A1 | 5/1996 |
| FR | 2345363 | A1 | 10/1977 |
| GB | 2253605 | A | 9/1992 |
| JP | 04215927 | A | 8/1992 |
| JP | 7-8236 | | 7/1995 |
| JP | 11029176 | A | 2/1999 |
| JP | 2000255598 | A | 9/2000 |
| JP | 2002503187 | | 1/2002 |
| JP | 2002037327 | | 2/2002 |
| JP | 2003146364 | | 5/2003 |
| WO | WO 96/23700 | A1 | 8/1996 |
| WO | WO 02/083504 | A1 | 10/2002 |
| WO | WO 2004/100856 | A2 | 11/2004 |
| WO | WO 2005/022323 | A | 3/2005 |
| WO | WO 2005/077811 | A1 | 8/2005 |
| WO | WO2009-086344 | A1 | 7/2009 |
| WO | WO2009-086346 | A1 | 7/2009 |
| WO | WO2009-088759 | A1 | 7/2009 |

OTHER PUBLICATIONS

U.S. Appl. No. 12/434,254, filed May 1, 2009, Package with one or More Access Points for Breaking one or more Seals and Accessing the Contents of the Package.

U.S. Appl. No. 12/704,914, filed Feb. 12, 2010 entitled Package Containing a Breachable Bubble in Combination with a Closure Device.

U.S. Appl. No. 12/703,947, filed Feb. 11, 2010, entitled Package with Unique Opening Device and Process for Forming Package.

* cited by examiner

STORAGE APPARATUS WITH A BREACHABLE FLOW CONDUIT FOR DISCHARGING A FLUID STORED THEREIN

TECHNICAL FIELD

This invention relates to a storage chamber having a flow conduit for easy discharge of a fluid stored therein, and more particularly to a bubble type flow conduit which is double-breached for accessing out to the ambient and into the chamber.

BACKGROUND

Simple product bags or pouches in common use, such as milk and water containers, typically do not have a pouring spout or even a provision for opening the bag. The user manually rips off a small corner piece or punctures the bag with a pointed tool, creating a jagged opening into the storage chamber. Pouring from such a crude opening is awkward, causing loss of contents.

U.S. Pat. No. 6,726,364 issued on Apr. 27, 2004 to the present inventor shows a breaching bubble which provides opposed peel flaps along a perimeter breach. The flaps are peeled back by the user to open a chamber and present a product. The subject matter of U.S. Pat. No. 6,726,364 is hereby incorporated by reference in its entirety into this disclosure.

SUMMARY

It is therefore an object of this invention to provide a storage apparatus having a storage chamber with a breachable flow conduit for discharging the chamber. The flow conduit is breached at each end establishing fluid communication between the ambient and the storage chamber. This controlled breaching provides a controlled opening and controlled pouring It is another object of this invention to provide a storage chamber for such an apparatus which may be accessed without tearing or puncturing, and without tools for cutting or puncturing. The flow conduit may be breached by applied pressure from the user's thumb and forefinger.

It is a further object of this invention to provide such a breachable flow conduit which promotes a directed laminar flow with minimum turbulence. Surface drag along the length of the flow conduit collimate the flow into a uniform discharge.

It is a further object of this invention to provide such a flow conduit having an easily regulated flow rate. The flow may be temporarily stopped by pressing the conduit closed. The pinching permits metered amounts of stored fluid to be released. Parallel flow conduits of varying flow capacities may be employed to obtain a particular flow rate.

It is a further object of this invention to provide such a flow conduit with enhanced barriers to fluid communication and discharge. A single long conduit may be sectioned into shorter conduits creating additional seals between chamber and ambient which must be breached.

Briefly, these and other objects of the present invention are accomplished by providing an apparatus for discharging a stored fluid contained therein out to the ambient. A storage chamber contains the stored fluid. A chamber access region proximate the perimeter of the apparatus, has a breachable flow conduit with an inner end proximate the storage chamber and an outer end proximate the perimeter. The flow conduit is formed by opposed laminae pressed into sealing engagement, forming an outer pressed seal and an inner pressed seal. The flow conduit expands towards the perimeter of the apparatus until the flow conduit creates a perimeter breach from the flow conduit out to the ambient through the outer pressed seal. The flow conduit also expands towards the storage chamber until the flow conduit creates a chamber breach from the flow conduit into the storage chamber through the inner pressed seal. The flow conduit is breached at both ends to establish fluid communication between the storage chamber and the ambient for discharge of the stored fluid.

BRIEF DESCRIPTION OF THE DRAWINGS

Further objects and advantages of the storage chamber and the flow conduit, will become apparent from the following detailed description and drawings (not drawn to scale) in which.

Figure 1A:
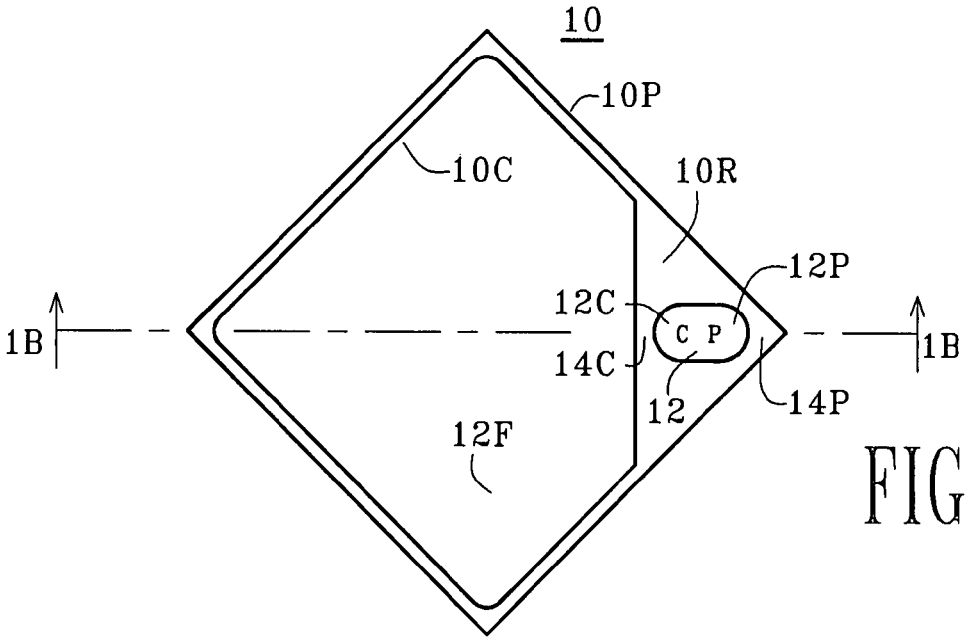
FIG. 1A shows apparatus 10 with storage chamber 10C, chamber access region 10R, and corner conduit 12.
Figure 1B:
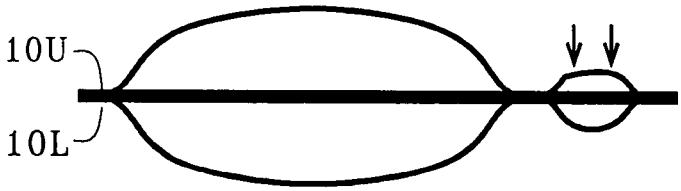
FIG. 1B is a cross-sectional view of apparatus 10 of FIG. 1A taken generally along reference line 1B thereof, showing apparatus 10 prior to breaching.
Figure 1C:
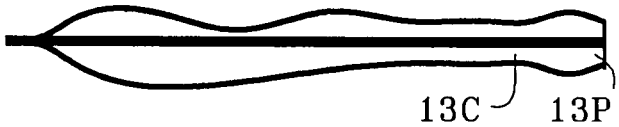
FIG. 1C is a cross-sectional view of apparatus 10 of FIG. 1D taken generally along reference line 1*c* thereof; after breaching showing perimeter breach 13P.
Figure 1D:
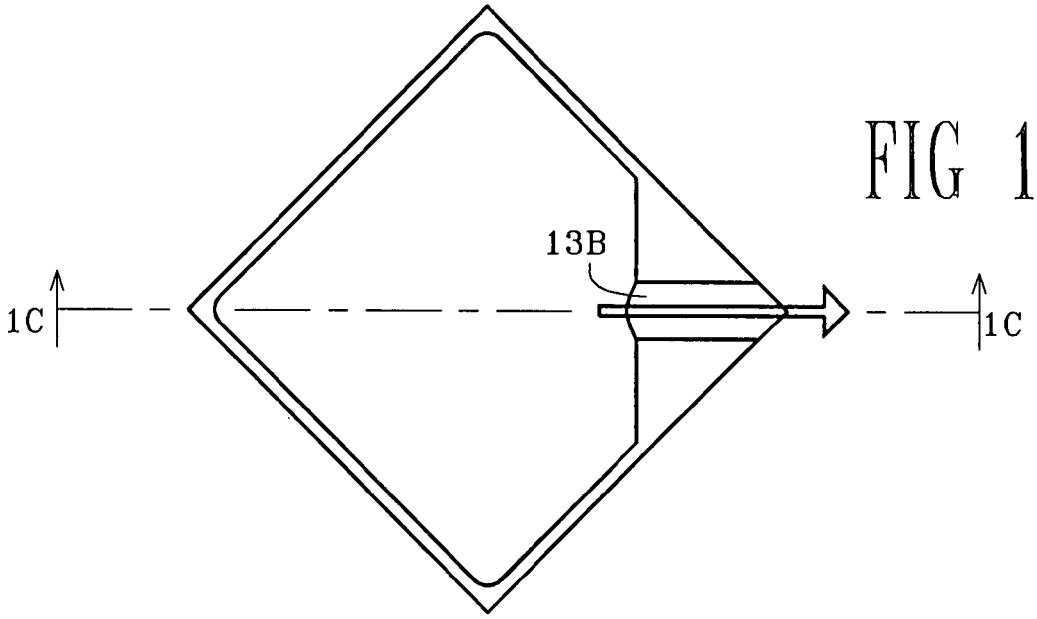
FIG. 1D shows apparatus 10 after breaching with breached corner conduit 12 discharging stored fluid 12F from storage chamber 10C into the ambient.

The first digit of each reference numeral in the above figures indicates the figure in which an element or feature is most prominently shown. The second digit indicates related elements or features, and a final letter (when used) indicates a sub-portion of an element or feature.

REFERENCE NUMERALS IN DRAWINGS

The table below lists the reference numerals employed in the figures, and identifies the element designated by each numeral.

| | |
|---|---|
| 10 | Apparatus |
| 10C | Storage Chamber |
| 10L | Lower Lamina |
| 10P | Apparatus Perimeter |
| 10R | Chamber Access Region |
| 10U | Upper Lamina |
| 12 | Flow Conduit |
| 12C | Inner End |
| 12F | Fluid |

-continued

| | |
|---|---|
| 12P | Outer End |
| 13B | Breached Conduit |
| 13C | Chamber Breach |
| 13P | Perimeter Breach |
| 14C | Inner Pressed Seal |
| 14P | Outer Pressed Seal |
| 20C | Storage Chamber |
| 22C | Inner Conduit |
| 22P | Outer Conduit |
| 23 | Discharge Spout |
| 23C | Conduit End |
| 23D | Discharge End |
| 24C | Inner Seal |
| 24P | Outer Seal |
| 26 | Barricade Dam |
| 26C | Inner Barrier Wall |
| 26P | Outer Barrier Wall |
| 30 | Apparatus |
| 32F | Fluid |
| 32X | Flow Conduit |
| 32Y | Flow Conduit |
| 32Z | Flow Conduit |
| 37 | Corner |
| 40 | Apparatus |
| 40C | Storage Chamber |
| 40P | Perimeter |
| 42S | Small Flow Conduit |
| 42L | Large Flow Conduit |
| 44L | Lateral Seal |
| 44M | Middle Lateral Seal |
| 44S | Lateral Seal |
| 50 | Apparatus |
| 52 | Flow Conduit |
| 54S | Strong Lateral Seal |
| 54F | Discharge Funnel |
| 54W | Weak Lateral Seal |
| 60 | Apparatus |
| 60C | Storage Chamber |
| 62A | Air Intake Conduit |
| 62D | Discharge Flow Conduit |
| 65A | In-Only Valve |
| 65D | Out-Only Valve |
| 67 | Corner |
| 70 | Apparatus |
| 70K | Storage Chamber |
| 70M | Storage Chamber |
| 70S | Storage Chamber |
| 72K | Flow Conduit |
| 72M | Flow Conduit |
| 72S | Flow Conduit |
| 72k | Stored Fluid |
| 72m | Stored Fluid |
| 72s | Stored Fluid |
| 80 | Apparatus |
| 80L | Left Storage Chamber |
| 80R | Right Storage Chamber |
| 82 | Flow Conduit |
| 84L | Left Inner Seal |
| 84P | Common Outer Seal |
| 84R | Right Inner Seal |
| 90 | Apparatus |
| 90C | Storage Chamber |
| 90P | Perimeter Breach |
| 92 | Flow Conduit |
| 92F | Stored Fluid |
| 94L | Lateral Seal |
| 97 | Corner |

General Embodiment—(FIGS. 1A, 1B, 1C and 1D)

Apparatus 10 has breachable flow conduit 12 for discharging stored fluid 12F contained in storage chamber 10C out to the ambient. The apparatus may be formed by upper lamina 10U and lower lamina 10L pressed into a sealing engagement to form bubble type flow conduits. Chamber access region 10R is positioned proximate perimeter 10P of the apparatus. The breachable flow conduit is within the access region, and has an inner end 12C proximate the storage chamber and an outer end 12P proximate the perimeter of the apparatus. The flow conduit has outer pressed seal 14P between the outer end of the flow conduit and the perimeter of the apparatus. The flow conduit also has inner pressed seal 14C between the inner end of the flow conduit and the edge of the storage chamber. The flow conduit expands towards the perimeter of the apparatus under external pressure, typically applied by the consumer. The pressure separates the opposed laminae of the outer pressed seal until the flow conduit breaches at the perimeter of the apparatus creating a perimeter breach 13P from the flow conduit into the ambient through the outer pressed seal. The flow conduit also expands towards the storage chamber under the applied pressure. The pressure separates the opposed laminae of the inner pressed seal until the flow conduit breaches at the edge of the storage chamber creating a chamber breach 13C from the flow conduit into the storage chamber through the inner pressed seal (see FIGS. 1C and 1D). The double breached flow conduit 13B establishes fluid communication between the storage chamber and the ambient for discharge of the stored fluid.

The flow conduit may be elongated, extending across the access region from the perimeter of the apparatus to the edge of the storage chamber. The flow drag along the sides of the conduit urges the flowing fluid into a laminar flow with minimal turbulence. The discharged fluid flows out of the conduit in a stream that can be directed.

The entire apparatus including both the storage chamber and the access region may be formed by the opposed laminae pressed into sealing engagement, which simplifies manufacture. Alternatively, only the access region, or just the flow conduit, may be formed by the pressed lamina material. The storage chamber may be formed of different material, avoiding long standing exposure of the stored fluid with the laminae material. The lamina material may be any suitable material such as plastic, paper (with wood and/or cotton content) fabric, cellophane, or biodegradable matter. A thin web made of materials such as mylar or plastic or aluminum, forms a flexible film with hermetic properties, and is commonly used as a tear-resistant packaging material.

The stored fluid may be any flowable liquid, syrup, slurry, dispersion, or the like. Low viscous fluids will flow under gravity downward out the storage chamber through the breached conduit out to the ambient. Higher viscous fluids may be squeezed out of a flexible bag chamber and through a breached conduit, like toothpaste. In addition, the stored fluid may be any pourable powder such as sugar, salt, medications, or the like, that can pass through the flow conduit. The particles of the powder roll, slide, cascade and tumble past each other in a fluid manner. Some powders may require a tap or shake of the apparatus in addition to gravity for discharge from the storage chamber. The outside ambient may be the general space or location of the consumer which is ordinary air. Alternatively, the ambient may be a controlled space, such as the inside another container or a space submerged under another fluid.

Opening the Apparatus

The flow conduit is expandable by external pressure applied by a consumer, to establish fluid communication from the chamber out to the ambient. The inner and outer seals may be breached separately by pressing twice, once at each end of the conduit. Alternatively, these seals may be breached simultaneously by pressing once in the center of conduit. For small conduits, the consumer may simply pinch the conduit or conduits between his thumb and finger. Slightly larger conduits may require thumb pressure against a hard surface such as a table. The consumer may direct the conduit expansion outward towards the ambient at perimeter 10P of the apparatus by applying pressure along outer end 12P of flow conduit 12 proximate point "P" (see FIG. 1A). The consumer may also direct the conduit expansion inward towards storage chamber 10C by applying pressure along inner end 12C of the conduit proximate point C.

The outward expansion of the conduit progressively separates the opposed laminae of outer seal 14P, along a moving separation frontier. The frontier moves across the outer seal until the frontier reaches the perimeter of the apparatus, where the conduit breaches creating perimeter breach 13P (see FIG. 1C). The inward conduit expansion separates the opposed laminae of inner seal 14C, along a similar moving separation frontier. The fluid in the conduit is forced away from the point of pressure toward the seals, which causes the separation of the seals. The conduit fluid is preferably a compressible gas, but may be any suitable liquid. The conduit gas is compressed by the applied pressure creating an expansive force. The outer seal may be resealable after perimeter breaching for resealing the apparatus.

The inner seal may be stronger than the outer seal due to a higher temperature and/or pressure and/or dwell-time during seal formation. That is, the inner seal may be fused together more than the outer seal. The outer seal may be breached first forcing conduit gas into the ambient. As the inner seal is breached, the conduit is pressed closed, preventing the loss of any stored fluid.

Figure 2:
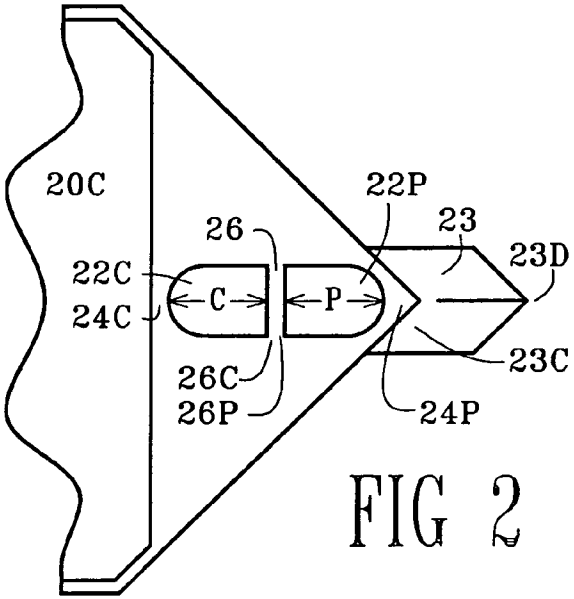
FIG. 2 shows a flow conduit divided by barricade dam 26, and with discharge chute 23.

Barricade Dam—(FIG. 2)

The flow conduit may have a barricade dam which presents additional pressed seal type barriers between the ambient and the chamber containing the stored fluid. In the embodiment of FIG. 2, barricade dam 26 is provided across the flow conduit, for dividing the flow conduit into an inner conduit section 22C proximate storage chamber 20C, and an outer conduit section 22P proximate the perimeter. The barricade has inner barrier wall 26C facing the inner conduit section, and outer barrier wall 26P facing the outer conduit section. The inner conduit section is expandable by applying pressure at point C. The expansion is inward toward inner seal 24C and storage chamber 20C, and also outward toward inner barrier wall 26C of the barricade. The outer conduit section is also expandable by applying external pressure at point C. The expansion is outward toward outer seal 24P and ambient, and also inward toward outer barrier wall 26P of the barricade. The expanding conduits merge into one another creating a barricade breach which eliminates the barricade dam. The expansion continues under applied pressure until the inner conduit chamber breaches into the storage chamber and the outer conduit perimeter breaches out to the ambient. The three breaches, the barricade breach and the chamber breach and the perimeter breach, establish fluid communication from the storage chamber to the ambient, permitting the discharge of the stored fluid. The three breach requirement reduces the possibility of accidental releases.

Figure 4:
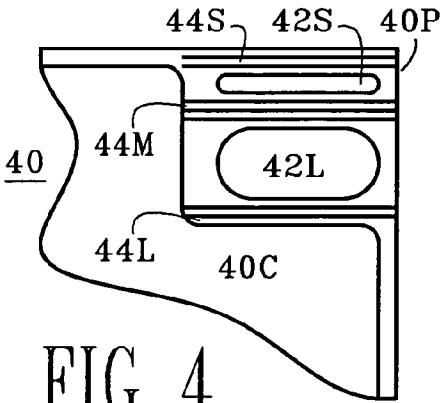
FIG. 4 shows multiple flow conduits 42S and 42L having different widths.
Figure 3:
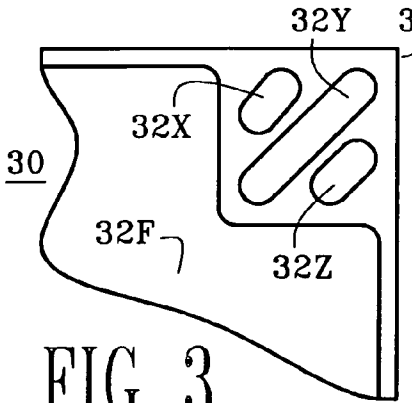
FIG. 3 shows multiple flow conduits 32× and 32Y and 32Z having the same width.

Multiple Conduits—(FIGS. 3 and 4)

The apparatus may have multiple flow conduits for providing multiple breaches establishing multiple fluid communications between the storage chamber and the ambient for multiple discharge flows of the stored fluid. Apparatus 30 has three flow conduits, 32X, 32Y and 32Z (see FIG. 3) which provide faster discharge of stored fluid 32F. The consumer may control the discharge flow rate. A single conduit may be breached for a slow flow, and additional conduits may be breached for higher flow rates. In the embodiment of FIG. 3 the multiple flow conduits have the same width and the same flow rates, for providing equal increases in the flow capacity.

Alternatively, multiple flow conduits may have different widths or flow cross-sections for providing multiple breached flow conduits with different flow capacities. Apparatus 40 has small flow conduit 42S and large flow conduit 42L (see FIG. 4) to provide small and large flow rates. An extra large flow rate may be provided by breaching both of the flow conduits. The small flow rate from the breach of small conduit 42S combines with the large flow rate from the breach of large conduit 42L to provide an extra large flow.

Figure 5:
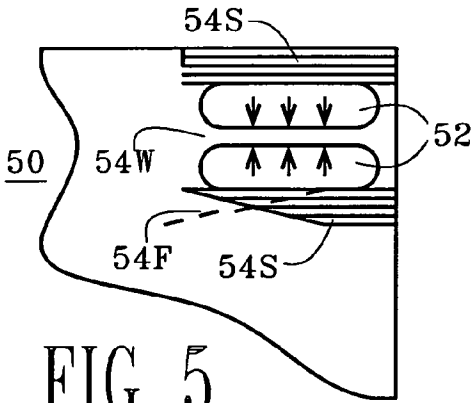
FIG. 5 shows adjacent narrow conduits 52 which laterally expand to merge into a single wide conduit.

Lateral Expansion—(FIGS. 4 and 5)

Lateral expansion of the expanding flow conduits may be resisted during the applied pressure by strong lateral seals. The lateral seals preferably extend along the sides of the elongated flow conduits from the storage chamber to the ambient. Apparatus 40 has three lateral seals, 44S and 44L and 44M (indicated by solid parallel lines). Lateral seal 44S prevents small flow conduit 42S from expanding into perimeter 40P causing a long and random perimeter breach. Lateral seal 44L prevents large flow conduit 42L from expanding into chamber 40C causing a long and random chamber breach. Middle lateral seal 44M located between the small and large flow conduits prevents the conduits from expanding into one another. The three lateral seals offer stiff resistance to lateral expansion, directing the pressure force within the flow conduits to cause expansion at the ends. Therefore, expansion due to the directed pressure is primarily outward towards the perimeter of the apparatus, and inward towards the chamber. The lateral seals may be stronger then either the inner seal or the outer seal due to a higher temperature and/or pressure and/or dwell-time during seal formation.

Alternatively, the lateral seals may be weak (soft) to permit lateral expansion during the applied pressure. Apparatus 50 (see FIG. 5) has flow conduits 52 with two strong outside lateral seals, 54S (indicated by parallel solid lines) and one weak internal lateral seal 54W. Weak lateral seal 54W is located between flow conduits 52 and permits lateral expansion of the conduits, which merge into one another forming a single larger conduit. The single larger conduit has a flow capacity greater than the sum of the two original conduits. For example, the two original flow conduits 52 each have a diameter of 6 mm and a flow cross-sectional area of approximately 28 square mm. The total original flow area is 56 square mm. The merged conduit has a diameter of 14 mm (6 mm plus 6 mm plus 2 mm for middle seal 54W) and a flow cross-section of approximately 154 square mm. The two mm of lateral merging increased the flow capacity by almost three times. The lower outside lateral seal 54S may become progressively weaker near the storage chamber to permit limited progressive lateral expansion and widening of conduit 52 near the storage chamber to form discharge funnel 54F (shown is dashed lines).

The access region within the apparatus may be located at a corner or between corners. Apparatus 30 has at least one corner 37, and the flow conduits positioned proximate that corner (see FIG. 3). The corner breach provided at the corner location facilitates the discharge of the stored fluid. Alternatively, the apparatus two corners or more, and the access region may be located proximate the middle between two corners. Apparatus 60 has at least two corners 67 (see FIG. 6), with flow conduit 62D positioned between the two corners.

Figure 6:
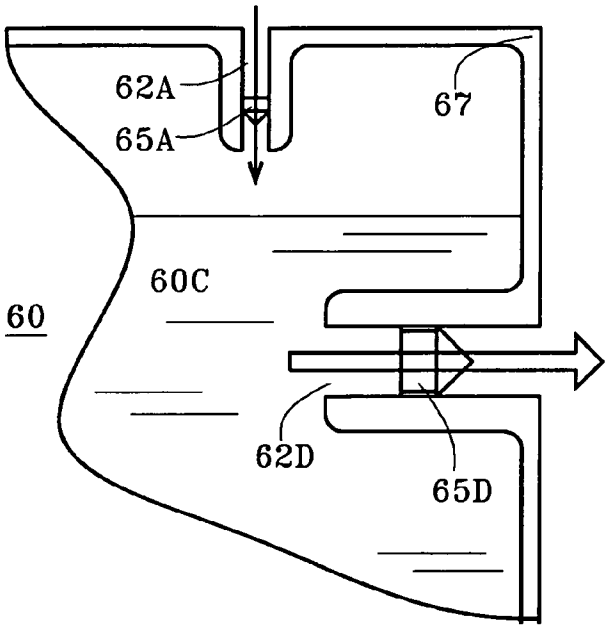
FIG. 6 shows out-only valve 65D positioned in discharge conduit 62D, and in-only valve 65A positioned in air intake conduit 62A.

Flow Valves—(FIG. 6)

In some applications ambient atmosphere must be kept out of the storage chamber. Apparatus 60 has out-only flow valve 65D positioned in flow conduit 62D (see FIG. 6) for preventing the entry of ambient air into storage chamber 60C. The storage chamber may be flexible as shown in FIG. 1 or rigid as shown in FIG. 6. Flexible storage chamber 10C collapses as the stored fluid is discharged. Ambient air does not enter the storage chamber. Further, flexible chambers are lightweight and may be crushed, rolled or wadded-up into a small size and easily discarded or recycled. The wadded up flexible chambers do not have a lids, caps, tabs and other tiny closure gadget which are hazardous to children and animals. Rigid storage chamber 60C is formed by a rigid, self-standing material, and cannot collapse as the chamber empties. Outside air must enter the storage chamber to replace the discharged fluid, or else a partial vacuum may develop in the chamber which inhibits discharge flow. Small air intake conduit 62A provides fluid communication between the rigid storage chamber and the ambient. The intake conduit permits the flow of replacement air into the chamber to replace the volume of storage fluid that was discharged out through breached flow conduit 62D. In-only air intake valve 65A is positioned in the air intake conduit to prevent stored fluid from escaping out the air intake conduit.

Figure 8:
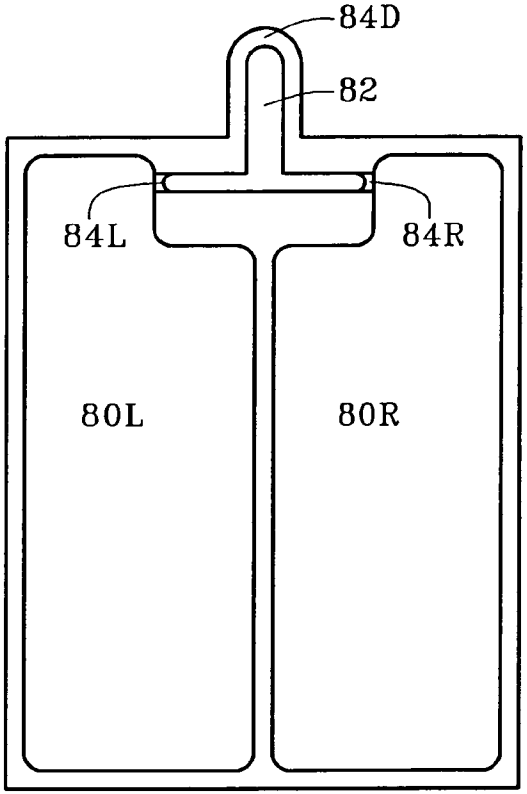
FIG. 8 shows multiple storage chambers 80L and 80R with common discharge conduit 82.
Figure 7:
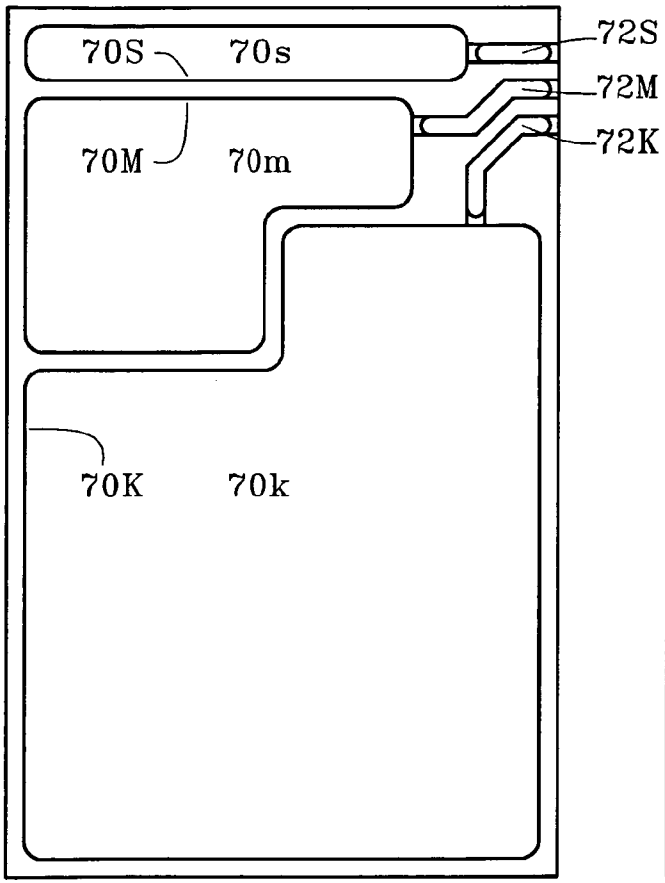
FIG. 7 shows multiple storage chambers 70K and 70M and 70S, each with a flow conduit 72K and 72M and 72S.

Multiple Chambers—(FIGS. 7 and 8)

The flow conduit apparatus may have multiple storage chambers for storing multiple fluids. In a three chamber embodiment (FIG. 7), apparatus 70 has first chamber 70K, which may be large for holding a primary fluid, for example coffee 70*k*. Primary flow conduit 72K extends from the main chamber to the ambient, and provides fluid communication therebetween when breached. Second chamber 70M may be smaller and hold a secondary fluid, for example milk 70*m*. Secondary flow conduit 72M extends from the second chamber to the ambient. Third chamber 70S may be even smaller and hold a tertiary fluid, for example a sweetener 70*s*. Tertiary flow conduit 72S extends from the third chamber to the ambient. The consumer may access the stored fluids separately or all together. For example, in the coffee embodiment, a consumer who wants black coffee breaches only primary flow conduit 72K to release the coffee from chamber 70K. A consumer who drinks coffee with cream breaches both primary flow conduit 72K and secondary conduit 72M to release the coffee from chamber 70K and the milk from chamber 70M. A consumer who drinks coffee with cream and sugar must breach all three flow conduits.

Alternatively, in some embodiments multiple stored fluids may be accessed simultaneously. Apparatus 80 has two storage chambers 80L and 80R (see FIG. 8), connected to "T" flow conduit 82 through left inner seal 84L and right inner seal 84R. The "T" flow conduit connects to the ambient through to common outer seal 84P. Breaching the three seals 84L and 84R and 84P, permits both fluids to discharge simultaneously.

Discharge Spouts—(FIGS. 2 and 8)

The apparatus may have a discharge spout extending from the breached flow conduit for guiding the discharge of the stored fluid. Discharge spout 23 (see FIG. 2) is an open chute having a conduit end 23C and a discharge end 23D. The spout projects from the flow conduit at the conduit end and guides the discharge at the discharge end. At least the discharge end of the discharge spout may be formed of semi-rigid material which may be bent and shaped to steer the discharge. Alternatively, the discharge spout may be a covered tube for guiding the discharge. Discharge spout 83 (see FIG. 8) is formed by opposed lamina pressed together. Outer seal 84 of the flow conduit is at the discharge end of the discharge spout.

Figure 9B:
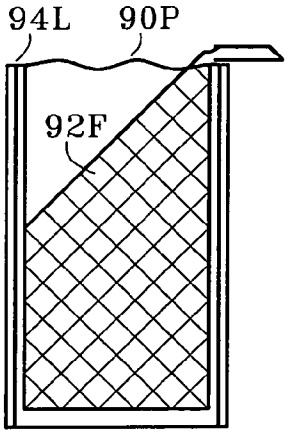
FIG. 9 shows flow conduit 92 breached along the entire end of storage chamber 90C.
Figure 9A:
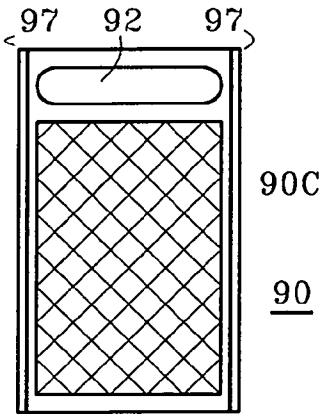

End Opening Embodiment—(FIG. 9)

The flow conduit may extend across the entire width of the apparatus to provide a large breach for quickly discharging the stored fluid. Apparatus 90 has flow conduit 92 which extends between end corners 97 (see FIG. 9A), occupying the entire width of apparatus 90. Perimeter breach 90P (see FIG. 9B) also extends the entire width between the two corners creating an end opening in the apparatus. The entire end of the apparatus becomes a discharge opening. Strong lateral seals 94L (indicated by solid parallel lines) may be employed to prevent lateral breaches and undirected lateral discharge. Stored fluid 92F, including powders (indicated by cross-hatching), may be easily discharged out the end opening of the apparatus.

Conclusion

It will be apparent to those skilled in the art that the objects of this invention have been achieved as described hereinbefore. Various changes may be made in the structure and embodiments shown herein without departing from the concept of the invention. Further, features of embodiments shown in various figures may be employed in combination with embodiments shown in other figures. Therefore, the scope of the invention is to be determined by the terminology of the following claims and the legal equivalents thereof.

I claim as my invention:

1. A storage apparatus comprising:

a storage chamber formed by opposed laminae pressed into sealing engagement;

a chamber access region proximate the perimeter of the apparatus;

a breachable flow conduit within the access region having an inner end proximate the storage chamber and an outer end proximate the perimeter of the apparatus, the breachable flow conduit defining a breachable bubble therein;

an outer pressed seal within the access region between the outer end of the flow conduit and the perimeter of the apparatus, formed by the opposed laminae being fused together;

an inner pressed seal within the access region between the inner end of the flow conduit and the edge of the storage chamber, formed by the opposed laminae being fused together, the inner pressed seal having a first wall proximate the inner end of the flow conduit and a second wall proximate the edge of the storage chamber, wherein the first wall, the second wall, or both are substantially linear;

the breachable bubble including a fluid sealed between the outer pressed seal and the inner pressed seal, the fluid comprising only a gas;

the flow conduit and bubble are expandable towards the perimeter of the apparatus by applied pressure, which separates the opposed laminae of the outer pressed seal until the flow conduit and bubble breach at the perimeter of the apparatus creating a perimeter breach from the flow conduit out to the ambient through the outer pressed seal;

the flow conduit and bubble are expandable towards the storage chamber by applied pressure, which separates the opposed laminae until the flow conduit and bubble breach at the edge of the storage chamber creating a chamber breach from the flow conduit into the storage chamber through the inner seal; and the flow conduit breached at both ends establishes fluid communication between the storage chamber and the ambient.

2. The apparatus of claim 1, wherein the flow conduit is elongated extending across the access region from the perimeter of the apparatus to the edge of the storage chamber.

3. The apparatus of claim 2, further comprising:

an out-only flow valve positioned in the flow conduit for preventing the entry of ambient atmosphere.

4. The apparatus of claim 2, further comprising:

a barricade across the flow conduit dividing the flow conduit into an inner conduit section and an outer conduit section;

the barricade having an inner barrier wall facing the inner conduit section and an outer barrier wall facing the outer conduit section;

the inner conduit section is expandable outward toward the inner barrier wall and inward toward the storage chamber;

the outer conduit section is expandable inward toward the outer barrier wall and outward toward the ambient;

until the conduit sections breach at the edge of the perimeter of the apparatus and at the edge of the storage chamber and at the barricade.

5. The apparatus of claim 2, further comprising:

a strong pressed seal along the sides of the elongated flow conduit to resist lateral expansion during the applied pressure.

6. The apparatus of claim 2, further comprising:

a weak pressed seal along the sides of the elongated flow conduit to permit lateral expansion during the applied pressure.

7. The apparatus of claim 6, wherein the weak pressed seal along at least one side of the elongated flow conduit is progressively weaker near the storage chamber to permit limited progressive lateral expansion and widening of the conduit near the storage chamber forming a discharge funnel.

8. The apparatus of claim 2, wherein the outer pressed seal is resealable after perimeter breaching for resealing the apparatus.

9. The apparatus of claim 2, further comprising:

multiple breachable flow conduits for establishing multiple fluid communications between the storage chamber and the ambient.

10. The apparatus of claim 9, wherein the multiple flow conduits have different flow cross-sections for providing multiple fluid communications having different flow capacities from the storage chamber out to the ambient.

11. The apparatus of claim 9, further comprising multiple storage chambers, each of the multiple storage chambers associated with at least one breachable flow conduit.

12. The apparatus of claim 11, wherein the breachable flow conduits have a common outer seal to the ambient.

13. The apparatus of claim 1, wherein the storage chamber and the access region are formed by opposed laminae pressed into sealing engagement.

14. The apparatus of claim 13, wherein the opposed laminae forming the storage chamber are flexible.

15. The apparatus of claim 1, wherein the storage chamber is formed by a rigid material.

16. The apparatus of claim 15, further comprising an air intake conduit between the rigid storage chamber and the ambient, for permitting the intake of ambient air to replace the volume discharged out through the breached flow conduit.

17. The apparatus of claim 16, further comprising an in-only air intake valve positioned in the air intake conduit.

18. The apparatus of claim 1, wherein the apparatus has at least one corner, and the flow conduit is positioned proximate that corner.

19. The apparatus of claim 1, wherein the apparatus has at least two corners, and the flow conduit is positioned between the two corners.

20. The apparatus of claim 19, wherein the flow conduit extends between the two corners creating a perimeter breach that also extends between the two corners.

21. The apparatus of claim 1, further comprising:

discharge spout having a conduit end and a discharge end, which spout projects from the flow conduit at the conduit end.

22. The apparatus of claim 21, wherein the discharge spout is an open chute.

23. The apparatus of claim 21, wherein at least the discharge end of the discharge spout is formed of semi-rigid material.

24. The apparatus of claim 21, wherein the discharge spout is a covered tube.

25. The apparatus of claim 21, wherein the discharge spout is formed by opposed lamina pressed together.

26. The apparatus of claim 25, wherein the outer pressed seal is at the discharge end of the opposed lamina discharge spout.

27. The apparatus of claim 1, wherein the storage chamber contains a stored fluid.

28. The apparatus of claim 27, wherein the stored fluid is a flowable liquid or syrup.

29. The apparatus of claim 27, wherein the stored fluid is a slurry or dispersion.

30. The apparatus of claim 27, wherein the stored fluid is a powder.

31. The apparatus of claim 27, wherein the stored fluid is a granulated solid.

32. The apparatus of claim 1, wherein the breachable flow conduit promotes a substantially laminar flow.

* * * * *